United States Patent [19]

Sugiura et al.

[11] Patent Number: 5,017,096

[45] Date of Patent: May 21, 1991

[54] VARIABLE CAPACITY COMPRESSOR

[75] Inventors: Hiroyuki Sugiura; Nobuyuki Nakajima; Takeo Iijima, all of Saitama, Japan

[73] Assignee: Diesel KikiCo., Ltd., Tokyo, Japan

[21] Appl. No.: 178,469

[22] Filed: Apr. 7, 1988

[30] Foreign Application Priority Data

Apr. 22, 1987 [JP] Japan ..... 62-099223

[51] Int. Cl.[5] ..... F04B 1/28

[52] U.S. Cl. ..... 417/222 S; 417/295

[58] Field of Search ..... 417/222 S, 270, 295; 62/228.5

[56] References Cited

U.S. PATENT DOCUMENTS

| | | | |
|---|---|---|---|
| 4,132,036 | 1/1979 | Koontz | 62/209 |
| 4,664,604 | 5/1987 | Terauchi | 417/222 S |
| 4,669,272 | 6/1987 | Kawai et al. | 417/270 |
| 4,687,419 | 8/1987 | Suzuki et al. | 417/222 S |
| 4,778,348 | 10/1988 | Kikuchi et al. | 417/222 S |
| 4,778,352 | 10/1988 | Nakajima | 417/295 |
| 4,780,060 | 10/1988 | Terauchi | 417/270 |

FOREIGN PATENT DOCUMENTS 61-215468 9/1986 Japan .

*Primary Examiner*—Leonard E. Smith

*Attorney, Agent, or Firm*—Frishauf, Holtz, Goodman & Woodward

[57] ABSTRACT

A variable capacity compressor for use in a heat-exchange circuit. A pressure responsive valve is provided in a communication passageway extending between a low pressure chamber and a pressure controlled chamber. The pressure responsive valve is operative in response to pressure within the low pressure chamber for opening and closing the communication passageway to control pressure within the pressure controlled chamber, thereby varying the capacity of the compressor in such a manner as to reduce the capacity when the pressure within the low pressure chamber decreases to a level lower than a predetermined value. An electrically operated control device is operative in response to pressure or temperature of refrigerant gas in an evaporator of the heat-exchange circuit for maintaining the capacity large independently of operation of the pressure responsive valve, even if the pressure within the low pressure chamber decreases to a level lower than the predetermined value.

19 Claims, 6 Drawing Sheets

VARIABLE CAPACITY COMPRESSOR

BACKGROUND OF THE INVENTION

The present invention relates to variable capacity compressors for use in heat-exchange circuits including evaporators, of air conditioning systems.

A variable capacity compressor is known, e.g. from Japanese Provisional Patent Publication (Kokai) No. 61-215468, in which pressure within a low pressure chamber of the compressor is detected, and a pressure-responsive valve is operative in response to the detected pressure to bring the low pressure chamber and a pressure-controlled chamber into or out of communication with each other, thereby varying the delivery quantity or capacity of the compressor. When a vehicle compartment, for example, is cooled by an air conditioning system employing such internally controlled variable capacity compressor, it takes a considerably long time unitl the vehicle compartment is cooled down, because the temperature of an evaporator of the air conditioning system drops in such a manner as to gradually approach a set value as indicated by the broken line A' in FIG. 2. The reason for this is that since the cooling load is large at the start of operation of the air conditioning system, the flow rate of the refrigerant gas is so large that pressure loss occurs between the evaporator and a suction chamber of the variable capacity compressor. That is, the pressure within the suction chamber drops due to the pressure loss, resulting in a drop of the pressure within the low pressure chamber. As a result, the pressure-responsive valve is operated in response to the pressure drop to reduce the delivery quantity or capacity of the compressor. In particular, if a connection line between the evaporator and the suction chamber of the compressor is long in distance, the temperature drop of the evaporator is slow, so that the vehicle compartment is not rapidly cooled down after the air conditioning system is started.

SUMMARY OF THE INVENTION

It is the object of the invention to provide a variable capacity compressor which has a simple construction but can expedite a temperature drop of the evaporator to early achieve a desired cooling effect.

According to the invention, there is provided a variable capacity compressor for use in a heat-exchange circuit including an evaporator having an outlet for a refrigerant gas, the compressor comprising:

a low pressure chamber connected to the outlet of the evaporator;

a pressure controlled chamber;

communication passageway means extending between the low pressure chamber and the pressure controlled chamber;

pressure responsive valve means provided in the communication passageway means and movable, in response to pressure within the low pressure chamber, between a closed position where the pressure responsive valve means closes the communication passageway means to bring the low pressure chamber and the pressure controlled chamber out of communication with each other and an open position where the pressure responsive valve means opens the communication passageway means to bring the low pressure chamber and the pressure controlled chamber into communication with each other, to control pressure within the pressure controlled chamber, thereby varying the capacity of the compressor in such a manner as to reduce the capacity when the pressure within the low pressure chamber decreases to a level lower than a predetermined value;

detecting means for detecting either one of pressure and temperature of the refrigerant gas in the evaporator, to generate a signal; and electrically operated control means operative in response to the signal from the detecting means for maintaining the capacity of the compressor large independently of operation of the pressure responsive valve means, even if the pressure within the low pressure chamber decreases to a level lower than the predetermined value.

The above and other objects, features and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
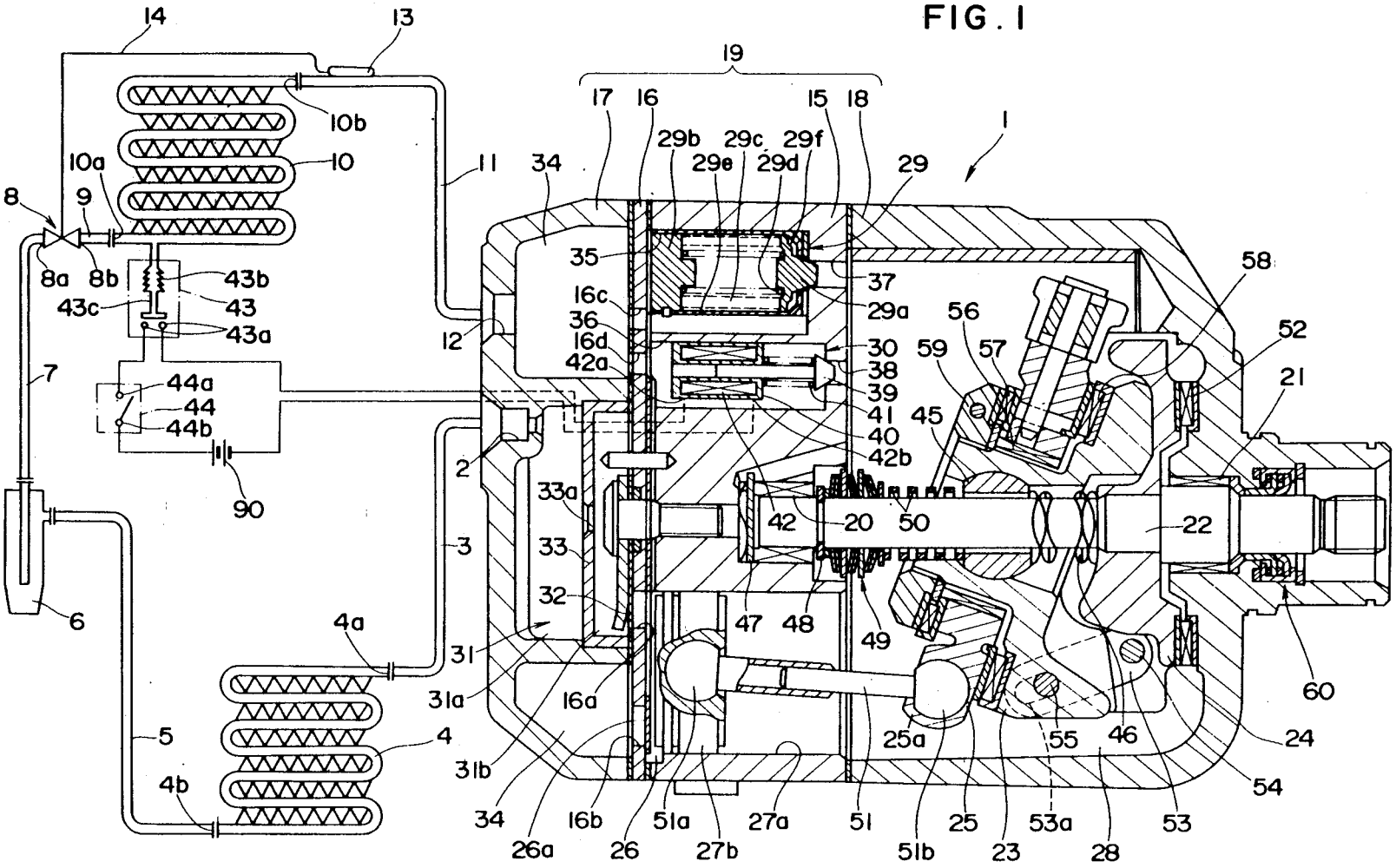
FIG. 1 is a view of the entire arrangement of a cooling system having incorporated therein a variable capacity compressor of wobble-plate type according to a first embodiment of the invention, the compressor being shown in longitudinal cross-section.

Referring to FIG. 1, there is illustrated the entire arrangement of a cooling system which has incorporated therein a variable capacity compressor of wobble-plate type according to a first embodiment of the invention. The variable capacity compressor of wobble-plate type (hereinafter referred merely to "the compressor"), generally designated by reference numeral 1, comprises a discharge port 2 which is connected to an inlet port **4*a* of a condenser 4 through a line 3. The condenser 4 has an outlet port 4*b* connected to an inlet port 8*a* of an expansion valve 8 through a line 5, a receiver 6 and a line 7, successively. The expansion valve 8 has an outlet port 8*b* connected to an inlet port 10*a* of an evaporator 10 through a line 9. The evaporator 10 has an outlet port 10*b* connected to an inlet port 12 of the compressor 1 through a line 11. A temperature sensitive tube 13 is mounted on the line 11 in close contact therewith, on the side of the outlet port 10*b* of the evaporator 10. The temperature sensitive tube 13 is connected to the expansion valve 8 through a capillary tube 14**.

The compressor 1 comprises a casing 19 which is composed of a cylinder block 15, a cylinder head 17 mounted in a fluid-tight manner on one axial end face (a left-hand end face as viewed in FIG. 1) of the cylinder block 15 through a valve plate 16, and a head member 18 mounted in a fluid-tight manner on the other end face (a right-hand end face as viewed in FIG. 1) of the cylinder block 15. A rotary shaft 22 is supported by the cylinder block 15 and the head member 18 through bearings 20 and 21. A rotary retainer member 24 is mounted on the rotary shaft 22 for rotation therewith to transmit rotation of the rotary shaft 22 to a wobble plate-attaching member 23. A wobble plate 25 is mounted on the rotary shaft 22 in such a manner that the angle of inclination of the wobble plate 25 with respect to the rotary shaft 22 can optionally be set. The wobble plate 25 swings about the axis of the rotor shaft 22 during rotation of the wobble plate-attaching member 23. The cylinder block 15 is formed therein with a plurality of cylinders 27*a* (only one shown in FIG. 1) which extend parallel to the axis of the rotary shaft 22 and which are spaced from each other circumferentially at predetermined intervals. A plurality of pistons 27*b* are slidably fitted in the respective cylinders 27*a*. Arranged within the cylinder block 15 are a first control valve 29 serving as pressure responsive valve means and a second control valve 30 serving as electrically operated control means. The first and second control valves 29 and 30 are adapted to control pressure within a crank chamber 28 which is defined by the cylinder block 15 and the head member 18.

The cylinder head 17 is generally flat and cylindrical in shape. A discharge pressure chamber or high pressure chamber 31 is defined within the cylinder head 17 generally at a center thereof. The above-mentioned discharge port 2 is formed in the cylinder head 17 and opens into the discharge pressure chamber 31 such that compressed refrigerant gas is discharged from the discharge pressure chamber 31 through the discharge port 2. A plurality of outlet ports 16*a* are provided in the valve plate 16 and open into the discharge pressure chamber 31 such that the refrigerant gas compressed by the pistons 27 is discharged into the discharge pressure chamber 31 through respective discharge valves 32. The discharge pressure chamber 31*a* is divided by a cover 33 into a first chamber 31*a* on the side of the discharge port 2 and a second chamber 31*b* on the side of the outlet ports 16. Both the first and second chambers 31*a* and 31*b* communicate with each other through a bore 33*a* formed in the cover 33 generally at a center thereof.

A suction chamber or low pressure chamber 34 is defined about an outer periphery of the discharge pressure chamber 31 within the cylinder head 17. The above-mentioned suction port 12 is formed in the cylinder head 17 and opens into the suction chamber 34 such that the refrigerant gas is drawn into the suction chamber 34 through the suction port 12. A plurality of inlet ports 16*b* are provided in the valve plate 16 and open into the suction chamber 34 such that the refrigerant gas is drawn into compression chambers 26 defined by the valve plate 16 and the respective pistons 27*b*, through respective suction valves 26*a*.

The cylinder block 15 is provided therein with a pair of accommodating bores 35 and 36 in which the above-mentioned first and second control valves 29 and 30 are accommodated, respectively. The accommodating bores 35 and 36 communicate with the crank chamber 28 through respective first and second comunication passageways 37 and 38 provided in the cylinder block 15. The accommodating bores 35 and 36 also communicate with the suction chamber 34 through respective communication ports 16*c* and 16*d* provided in the valve plate 16. The first control valve 29 is composed of a valve member 29*a* opening and closing the first communication passageway 37, a base plate 29*b*, a bellows 29*c* interposed between the base plate 29*b* and the valve member 29*a*, a spring 29*d* accommodated in the bellows 29*c* for biasing the valve member 29*a* in such a direction as to cause same to close the first communication passageway 37, and a cylindrical member 29*e* accommodating these component parts. The valve member 29*a* has a pressure-receiving face 29*f* which receives suction pressure Ps within the suction chamber 34. The bellows 29*c* is adapted to expand and contract in response to the suction pressure Ps within the suction chamber 34 introduced through the communication port 16*c*. The arrangement is such that when the suction pressure Ps is higher than a predetermined value, the bellows 29*c* contracts against the force of the spring 29*d* to move the valve member 29*a* away from the first communication passage 37 thereby opening same, while when the suction pressure Ps is lower than the predetermined value, the bellows 29*c* expands so that the valve member 29*a* is moved under the biasing force of the spring 29*d* toward the first communication passageway 37 thereby closing the same. It will thus be seen that the first control valve 29 is movable, in response to the pressure Ps within the suction chamber 34, between a closed position where the first control valve 29 closes the first communication passageway 37 to bring the suction chamber 34 and the crank chamber or pressure controlled chamber 28 out of communication with each other and an open position where the first control valve 29 opens the first communication passageway 37 to bring the suction chamber 34 and the crank chamber or pressure controlled chamber 28 into communication with each other.

The second control valve 30 is composed of a valve member 39 opening and closing the second communication passageway 38, an electromagnetic actuator or electrically operated actuator 40, and a spring 41 interposed between the electromagnetic actuator 40 and the valve member 39 for biasing same in such a direction as to close the second communication passageway 38. The electromagnetic actuator 40 has an electromagnetic coil 42 whose first terminal 42*a* is electrically connected to one of a pair of terminals of a fixed contact 43*a* of an evaporator switch 43 serving as detecting means arranged in the vicinity of the evaporator 10. The second terminal 42*b* of the electromagnetic coil 42 is electrically connected to an electric power source 90. The evaporator switch 43 is mounted on a tip of a branch line extending from the evaporator 10. The evaporator switch 43 is composed of a bellows 43*b* expanding and contracting in response to pressure Pe of the refrigerant gas within the evaporator 10, a movable contact 43*c* mounted on a tip of the bellows 43*b*, and the above-mentioned fixed contact 43*a* with which the movable contact 43*c* is moved into and out of contact. The other terminal of the fixed contact 43*a* is connected to a fixed contact 44*a* of a manual switch 44. A movable contact 44*b* of the manual switch 44 is connected to the electric power source 90. The evaporator switch 43 is movable between ON and OFF positions. Specifically, when the pressure Pe of the refrigerant gas within the evaporator 10 is higher than a predetermined value, the bellows 43*b* expands to bring the movable contact 43*c* into contact with the fixed contact 43*a* so that the evaporator switch 43 is moved to the ON position where the electric power source 90 and the second control valve 30 are electrically connected to each other. When the evaporator switch 43 assumes the ON position, the second control valve 30 is moved to an energized or open position where the second control valve 30 opens the second communication passageway 38. On the other hand, when the pressure Pe within the evaporator 10 is lower than the predetermined value, the bellows 43*b* contracts to bring the movable contact 43*c* out of contact with the fixed contact 43*a* so that the evaporator switch 43 is moved to the OFF position where the electric power source 90 and the second control valve 30 are electrically disconnected from each other. When the evaporator switch 43 assumes the OFF position, the second control valve 30 is moved to a deenergized or closed position where the second control valve 30 closes the second communication passageway 38. Thus, the second control valve 30 is operative in response to the pressure Pe within the evaporator 10, independently of the operation of the first control valve 29, that is, independently of the suction pressure Ps within the suction chamber 34, to move the valve member 39 into open and closed positions to bring the crank chamber 28 and the suction chamber 34 into and out of communication with each other, thereby controlling the pressure within the crank chamber 28.

The above-mentioned manual switch 44 is arranged at a location where the switch 44 can be operated by the driver, to enable the driver to select, on his judgment, a rapid cool mode or a fuel consumption-saving mode in which the cooling system should be operated. When the manual switch 44 is turned on, the cooling system is operated in the rapid cooling mode, while when the manual switch 44 is turned off, the cooling system is operated in the fuel consumption-saving mode.

The rotary shaft 22 is supported by the above-mentioned bearings 20 and 21. A hinge ball 45 serving as a fulcrum for swinging movement of the wobble plate 25 is mounted on the rotary shaft 22 generally at an axial center thereof. Wave springs 46 are arranged between the hinge ball 45 and the rotary retainer member 24. A stopper 48 is mounted on the rotary shaft 22 at a location between the hinge ball 45 and a conical washer 47. A plurality of belleville springs 49 and a coil spring 50 are arranged between the stopper 48 and the hinge ball 45.

The pistons 27*b* are universally connected respectively to tips 25*a* of the wobble plate 25 through respective piston rods 51 each having balls 51*a* and 51*b*. Swinging movement of the wobble plate 25 causes the pistons 27*b* to be axially reciprocated within the respective cylinders 27*a* through the respective piston rods 51. Thrust load generated by this swinging movement is borne by a thrust bearing structure 52 arranged between the rotary retainer member 24 and the head member 18.

The rotary retainer member 24 is connected to the wobble plate-attaching member 23 through a link pin 53. The link pin 53 has one end pivotally connected to the rotary retainer member 24 through a pin 54. The other end of the link pin 53 is provided with an elongated slot 53*a*, and is pivotally connected to the wobble plate-attaching member 23 through a pin 55 in such a manner that the pin 55 is movable along the slot 53*a*.

The wobble plate 25 is mounted on the swash plate-attaching member 23 for rotation relative thereto through a bearing 56 and a thrust bearing structure including thrust bearings 57 and 58 which are fixedly mounted on the wobble plate-attaching member 23 by a bearing retainer plate 59.

In FIG. 1, refernce numeral 60 denotes a seal structure for the rotary shaft 22.

The operation of the compressor constructed as above will next be described with reference to FIGS. 1 and 2. As the rotary shaft 22 rotates in association with a vehicle engine or the like, rotation of the rotary shaft 22 is transmitted to the wobble plate-attaching member 23 through the rotary retainer member 24 mounted on the rotary shaft 22, the pin 54, the link pin 53 and the pin 55. Following rotation of the rotary shaft 22, the wobble plate-attaching member 23 imparts swinging movement to the wobble plate 25, which has a swinging movement fulcrum at the hinge ball 45. This swinging movement causes the wobble plate 25 to reciprocate the pistons 27*b* to the right and left as viewed in FIG. 1, through the respective piston rods 51 connected respectively to the tips 25*a* of the wobble plate 25. During the suction stroke (moving stroke to the right as viewed in FIG. 1) of the pistons 27*b*, the refrigerant gas within the evaporator 10 reaches the inlet port 12 of the compressor 1 through the line 11. The refrigerant gas further flows into the compression chambers 26 through the suction chamber 34, the suction ports 16*b* and the suction valves 26*a*. The refrigerant gas within the compression chambers 26 is compressed during the compression stroke (moving stroke to the left as viewed in FIG. 1) of the pistons 27*b*. The compressed refrigerant gas flows through the outlet ports 16*a* and forces to open the discharge valves 32 so that the refrigerant gas reaches the discharge pressure chamber 31. The refrigerant gas is then delivered from the discharge pressure chamber 31 to the condenser 4 through the discharge port 2 and the line 3.

During such operation of the compressor, the suction pressure Ps within the suction chamber 34 is introduced into the accommodating bores 35 and 36 of the respective first and second control valves 29 and 30 through the respective communication ports 16*c* and 16*d*. On the other hand, the discharge pressure Pd within the discharge pressure chamber 31 is introduced into the crank chamber 28 as blow-by gas pressure. Thus, when the electromagnetic coil 42 of the second control valve 29 is deenergized and at the same time the second control valve 29 is in the closed position, a force acting in such a direction as to move the valve member 29*a* of the first control valve 29 toward the open position or in the left-hand direction as viewed in FIG. 1 is the sum of a force [=(the pressure within the accommodating bore 36, i.e., the suction pressure Ps)×(the area of the pressure-receiving face 29*f* of the valve member 29*a*)] and a force [=(the pressure Pc within the crank chamber 28)×(the cross-sectional area of the communication passageway 37)]. That is, when the total force is higher than the force of the spring 29*d*, the valve member 29*a* is moved to the open position to bring the suction chamber 34 and the crank chamber 28 into communication with each other. This causes the pressure Pc within the crank chamber 28 to leak into the suction chamber 34 so that the pressure Pc within the crank chamber 28 decreases. As a result, the reaction force acting upon the pistons 27*b* overcomes the pressure Pc within the crank chamber 28 to increase the angle of inclination of the wobble plate 25. This results in an increase in the stroke of the pistons 27*b* so that the capacity of the compressor 1 is increased. Conversely, when the total force is lower than the force of the spring 29*d*, the valve member 29*a* is not moved to the open position, i.e., remains in the closed position to bring the suction chamber 34 and the crank chamber 28 out of communication with each other. Accordingly, the pressure Pc within the crank chamber 28 is brought to a high pressure level by the blow-by gas. As a consequence, the reaction force acting upon the pistons 27 is overcome by the pressure within the crank chamber 28 to reduce the angle of inclination of the wobble plate 25. This results in a decrease in the stroke of the pistons 27 so that the capacity of the compressor 1 is reduced. In this way, the first control valve 29 is moved between the open and closed positions in response to a change in the suction pressure Ps within the suction chamber 34, whereby the pressure Pc within the crank chamber 28 is controlled. Thus, the capacity of the compressor 1 can be controlled to vary in a continuous fashion. In this case, the crank chamber 28 serves as a pressure controlled chamber in which the pressure Pc is controlled.

When the cooling system having incorporated therein the above-described wobble plate type compressor in which the capacity can be controlled to vary in a continuous fashion is started to operate in such a state that the switch 44 illustrated in FIG. 1 is turned on, i.e., in a rapid cooling mode, the bellows 29*c* of the first control valve 29 contracts because the suction pressure Ps within the suction chamber 34 at the start of operation is higher than the predetermined value. The valve member 29*a* opens the communication passageway 37 against the force of the spring 29*d* to bring the suction chamber 34 and the crank chamber or pressure controlled chamber 28 into communication with each other.

On the other hand, when the cooling system has just been started to operate, the pressure Pe within the evaporator 10 is also higher than the predetermined value, i.e. a pressure level $Pt_1$ corresponding to a temperature level $t_1$ at which the evaporator switch 43 is turned off. Accordingly, the bellows 43*b* of the evaporator switch 43 expands to bring the movable contact 43*c* into contact with the fixed contact 43*a* so that the evaporator switch 43 is turned on to energize the electromagnetic coil 42 of the second control valve 30. This causes the valve member 39 to open the communication passageway 38 against the force of the spring 41, thereby bringing the suction chamber 34 and the crank chamber or pressure controlled chamber 28 into communication with each other. Thus, the pressure Pc within the crank chamber or pressure controlled chamber 28 leaks into the suction chamber 34 on the low pressure side through the communication passageways 37 and 38, the accommodating bores 35 and 36 and the communication ports 16*c* and 16*d* so that the crank chamber 28 is reduced in pressure. The reaction force acting upon the pistons 27 overcomes the pressure Pc within the crank chamber or pressure controlled chamber 28 so that the angle of inclination of the wobble plate 25 increases. This increases the stroke of the pistons 27*b* so that the capacity of the compressor increases. Since, however, the increased capacity causes the refrigerant gas flowing into the suction chamber 34 to become large in quantity, a differential pressure occurs between the pressure Pe within the evaporator 10 and the suction pressure Ps within the suction chamber 34. As the suction pressure Ps is brought to a level lower than the predetermined value, the bellows 29*c* expands so that the valve member 29*a* is biased under the force of the spring 29*d* to close the communication passageway 37.

However, if the pressure Pe within the evaporator 10 is higher than the above-mentioned pressure $Pt_1$, the evaporator switch 43 remains in the ON position, because the bellows 43*b* of the evaporator switch 43 is in an expanded state. Accordingly, the communication passageway 38 is kept open by the valve member 39 so that the suction chamber 34 and the crank chamber or pressure controlled chamber 28 remain in communication with each other. Thus, the pressure Pc within the crank chamber or pressure controlled chamber 28 remains low and, therefore, the capacity of the compressor remains maximum. Consequently, the temperature t within the evaporator 10 drops rapidly from the initial temperature level $t_3$ at the start of operation of the cooling system toward a target temperature tc as indicated by the solid line A in FIG. 2. As the temperature t within the evaporator 10 is brought to a level lower than the target temperature tc and further to a level lower than the freezing temperature $t_0$, the pressure Pe within the evaporator 10 is also brought to a level lower than the above-mentioned temperature $Pt_1$, so that the bellows 43*b* of the evaporator switch 43 contracts to turn the evaporator switch 43 off. The valve member 39 closes the communication passageway 38 under the force of the spring 41 to bring the suction chamber 34 and the crank chamber or pressure controlled chamber 28 out of communication with each other. Accordingly, the pressure Pc within the crank chamber or pressure controlled chamber 28 is rapidly increased to a high level by the blow-by gas pressure. The reaction force acting upon the pistons 27*b* is overcome by the pressure Pc within the crank chamber or pressure controlled chamber 28 to reduce the angle of inclination of the wobble plate 25. This reduces the stroke of the pistons 27*b* so that the capacity of the compressor decreases.

Accordingly, after having dropped to the temperature level $t_1$, the temperature within the evaporator 10 is turned to a rise and reaches the target temperature tc. Subsequently, in a manner like that described above, the temperature t within the evaporator 10 is kept at the target temperature tc as indicated by the solid line A in FIG. 2. Thus, a period of time $\alpha$ required for the temperature t within the evaporator 10 to be brought from the initial temperature $t_3$ at the start of operation of the cooling system, to the target temperature tc is considerably shortened as compared with a period of time $\beta$ according to the changing characteristic of the prior art as indicated by the broken line A' in FIG. 2. Thus, it is possible to considerably shorten the cooling-down period of time of the cooling system.

Figure 2:
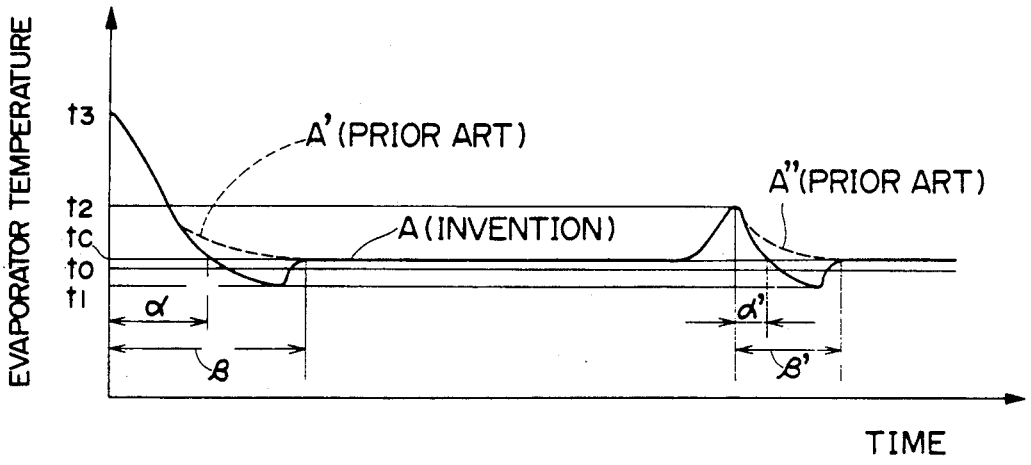
FIG. 2 is a graphical representation of a change in temperature of an evaporator plotted with respect to the lapse of time.

If the engine continues to run at a low rotational speed because of temporary stoppage of the vehicle or by other reasons so that the compressor capacity becomes insufficient with respect to the cooling load even if the compressor is in the maximum capacity position, the evaporator temperature rises and the line A in FIG. 2 gradually rises. However, as the evaporator temperature rises to a level $t_2$, the evaporator switch 43 is turned on at the pressure level corresponding to the temperature level $t_2$. Accordingly, at the subsequent cooling-down, the compressor maintains its maximum capacity until the evaporator temperature is brought to the level $t_1$ in a manner like that described above. Therefore, the cooling-down is completed within a short period of time $\alpha'$, as compared with the conventional period of time $\beta'$.

Figure 3:
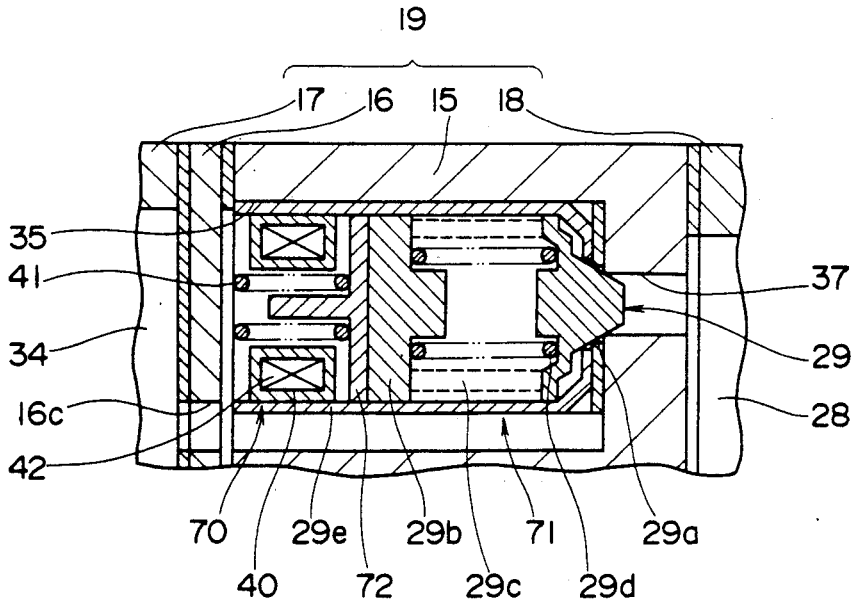
FIG. 3 is a fragmental cross-sectional view showing a control arrangement of a variable capacity compressor according to a second embodiment of the invention.

A second embodiment of the invention will next be described with reference to FIG. 3. In FIG. 3, the same reference numerals are used to designate component parts like or similar to those of the first embodiment shown in FIG. 1, and the detailed description of such like or similar component parts is therefore omitted. Except for the construction of FIG. 3, the second embodiment is identical with the construction of FIG. 1. Therefore, the following description is made with reference to FIG. 1, too. In order to control the pressure Pc within the crank chamber or pressure controlled chamber 28, the above-described first embodiment comprises the first control valve 29 for opening and closing the communication passageway 37 in response to the suction pressure Ps and the second control valve 30 for opening and closing the communication passageway 38 in response to operations of the evaporator switch 43 and the switch 44 regardless of the suction pressure Ps. However, the second embodiment illustrated in FIG. 3 comprises, in place of the first and second control valves, a control device 70 in which holding means 71 for holding the communication passageway 37 open by means of the evaporator switch 43 and the switch 44 regardless of the suction pressure Ps is added to the first control valve 29 for opening and closing the communication passageway 37 in response to the suction pressure Ps.

That is, in the control device 71, the holding means 70 is accommodated within the cylindrical member **29*e* of the first control valve 29. The holding means 70 is composed of a movable core 72 secured to an end face of the base plate 29*b* facing toward a valve plate 16, an electromagnetic actuator 40 interposed between the movable core 72 and the valve plate 16, and a spring 41 interposed between the movable core 72 and the valve plate 16 for biasing the movable core 72 in such a direction as to cause the valve member 29*a* to close the communication passageway 37**.

Like the first embodiment, the terminals of the electromagnetic coil 42 of the electromagnetic actuator 40 are electrically connected to the evaporator switch 43, the switch 44 and the electric power source 90. In the state of FIG. 3, the suction pressure Ps within the suction chamber 34 is so low that the bellows **29*c* is expanded to bias the valve member 29*a* to close the communication passageway 37. In this state, the spring 29*d* is fully stretched. Accordingly, if the pressure Pe within the evaporator 10 then increases to turn the evaporator switch 43 on and if the switch 44 is then turned on, the electromagnetic coil 42 of the electromagnetic actuator 42 is energized so that the attracting force of the electromagnetic coil 42 causes the movable core 72 to be moved in the valve opening direction or the leftward direction as viewed in FIG. 3, against the force of the spring 41. Therefore, the valve member 29*a* opens the communication passageway 37. Conversely, even in such a state that the pressure Ps within the suction chamber 34 is high to cause the valve member 29*a* to open the communication passageway 37 and that the pressure Pe within the evaporator 10 is also high to turn the evaporator switch 43 on to cause the attracting force of the electromagnetic coil 42 to move the valve member 29*a* in the valve opening direction against the force of the spring 41, the holding means 70 does not operate, if the switch 44 is turned off by the external command, that is, if the fuel consumption-saving mode is selected. In this case, only the first control valve 29 operates to open and close the communication passageway 37** in response to the suction pressure Ps. The remaining construction and operation of the second embodiment are similar to those of the aforedescribed first embodiment, and the description of the remaining construction and operation of the second embodiment are therefore omitted.

Figure 4:
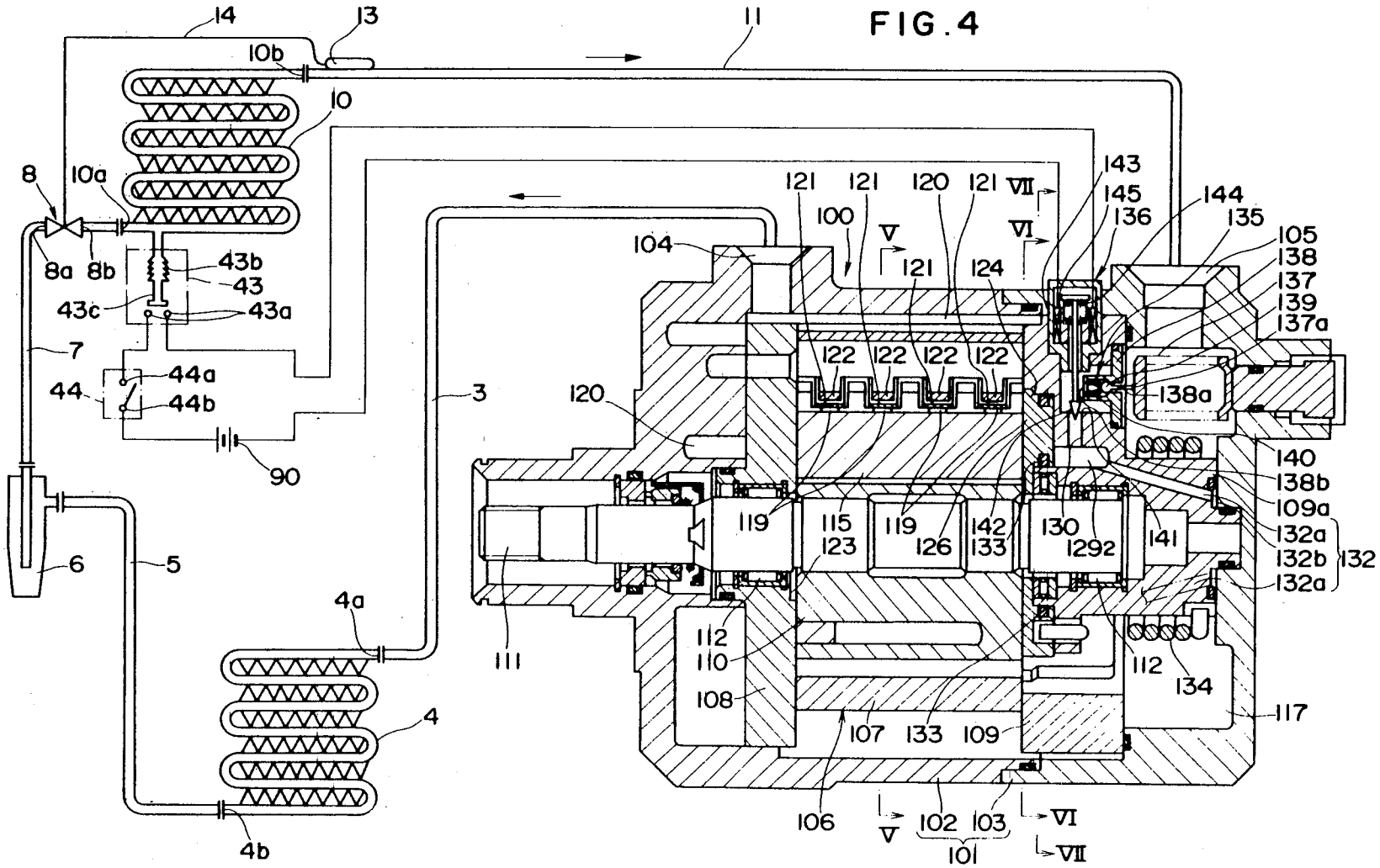
FIG. 4 is a view similar to FIG. 1, but showing a cooling system having incorporated therein a variable capacity compressor of vane type according to a third embodiment of the invention.

A third embodiment of the invention will next be described with reference to FIGS. 4 through 7. FIG. 4 shows the entire arrangement of a cooling system having incorporated therein a variable capacity compressor of vane type according to the third embodiment of the invention. in FIG. 4, the same reference numerals are used to designate component parts like of similar to those of the first embodiment shown in FIG. 1, and the detailed description of such like or similar component parts is therefore omitted.

The third embodiment is different from the first embodiment in that a vane compressor is employed as a variable capacity compressor for use in a cooling system.

As shown in FIG. 4, the variable capacity compressor of vane type (hereinafter referred merely to as "the compressor"), generally designated by reference numeral 100, comprises a casing 101 which is composed of a cylindrical case 102 having an axial open end, and a rear head 103 mounted on the case 102 by means of bolts (not shown) so as to close the axial open end of the case 102. A discharge port 104 for refrigerant gas as a thermal medium is provided at an upper portion of a front end of the case 102. A suction port 105 for the refrigerant gas is provided at an upper portion of the rear head 103.

Accommodated within the casing 101 is a pump body 106 which has principal elements including a cam ring 107, a front side block 108 and a rear side block 109 which are secured to the cam ring 107 so as to close opposite open ends thereof, a cylindrical rotor 110 rotatably received within the cam ring 107, and a rotary shaft 111 supporting the rotor 110 secured thereon. The rotary shaft 111 is rotatably supported by radial bearings 112 and 112 which are arranged respectively in the side blocks 108 and 109.

The rotor 110 is formed therein with a plurality of, e.g. five, radially extending vane slits 113 which are arranged in circumferentiaslly equidistantly spaced relation to each other. Back pressure chambers 114 are formed respectively in the rotor 110 at the bottoms of the respective vane slits 113. Vanes $115_1$ through $115_5$ are fitted in the respective vane slits 113 for radial sliding movement therealong.

Figure 5:
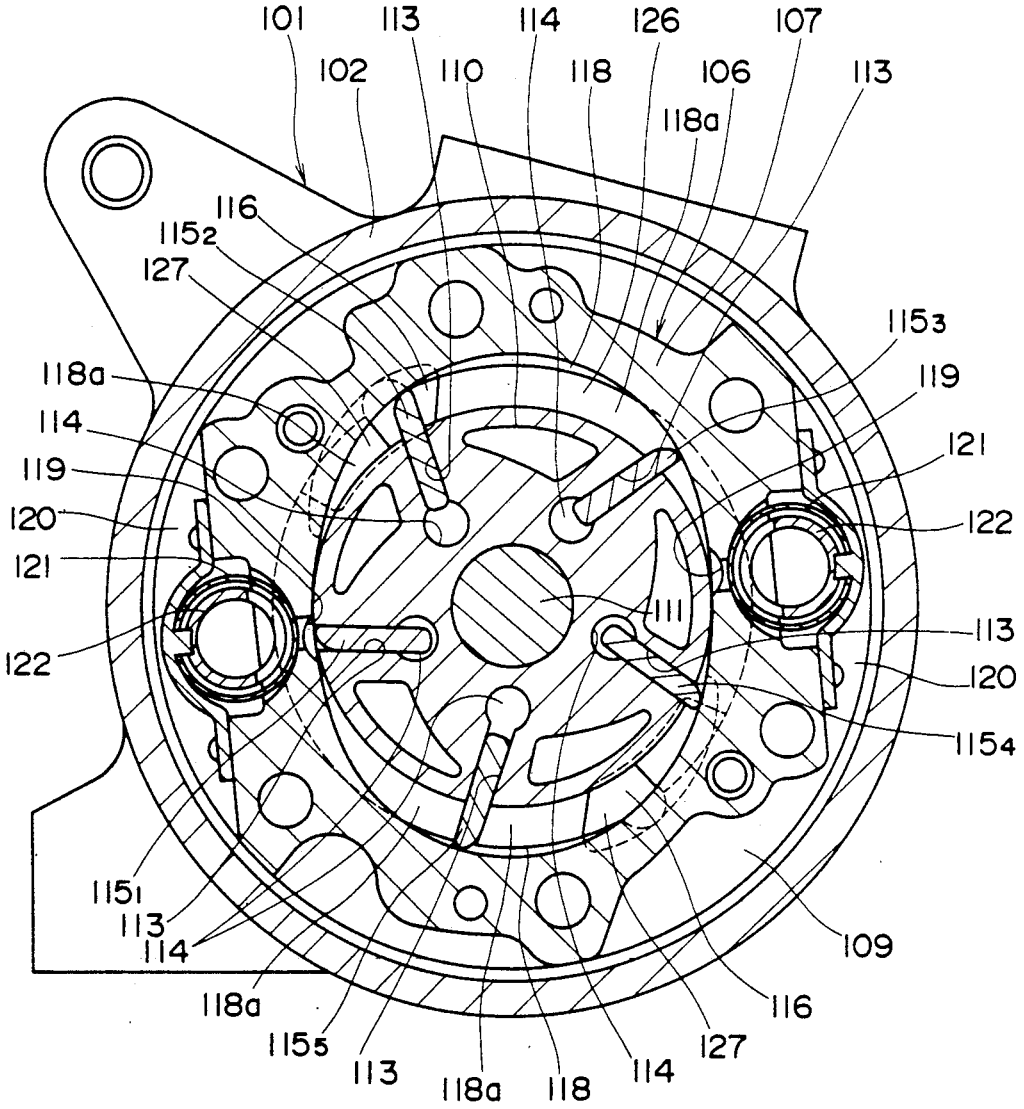
FIG. 5 is a transverse cross-sectional view taken along the line V—V in FIG. 4.

The rear side block 109 is formed therein with a pair of inlet ports 116 and 116 arranged in diametrically opposite relation to each other, as shown in FIG. 5. The inlet ports 116 and 116 axially extend through the rear side block 109. A suction chamber or low pressure chamber 117 defined between the rear head 103 and the rear side block 109 communicates with compression chambers 118 defined in spaces 118, 118 between adjacent vanes $115_1$, $-115_5$, through the inlet ports 116 and 116.

As shown in FIGS. 4 and 5, two sets of outlet ports 119 are formed, in diametrically opposite relation to each other, through a peripheral wall of the cam ring 107. Each set includes a plurality of, e.g. four, outlet ports 119 arranged axially of the rotor shaft 111. The compression chambers **118*a* communicate, through the outlet ports 119, with a discharge pressure chamber or high pressure chamber 120 defined between an inner peripheral surface of the casing 101 and an outer peripheral surface of the cam ring 107. The outlet ports 119** have associated therewith respective discharge valves 121 and respective valve retainers 122.

As shown in FIG. 4, a pair of arcuate back pressure-communicating grooves 123 and 123 are formed in an end face of the front side block 108 on the side of the rotor 110, at diametrically opposite locations. The back-pressure communicating grooves 123 and 123 circumferentially extend along a peripheral edge of the rotary shaft 111.

Figure 6:
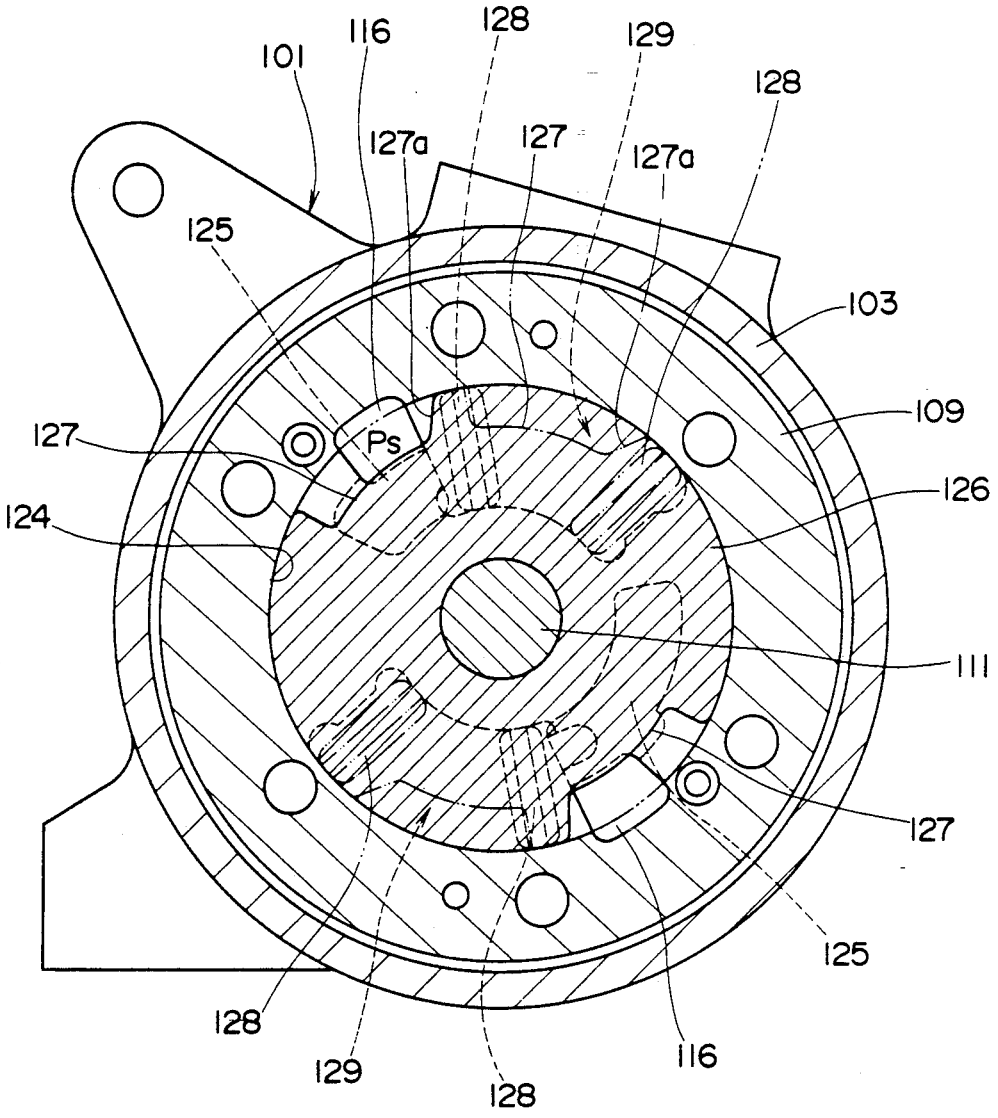
FIG. 6 is a transverse cross-sectional view taken along the line VI—VI in FIG. 4.
Figure 7:
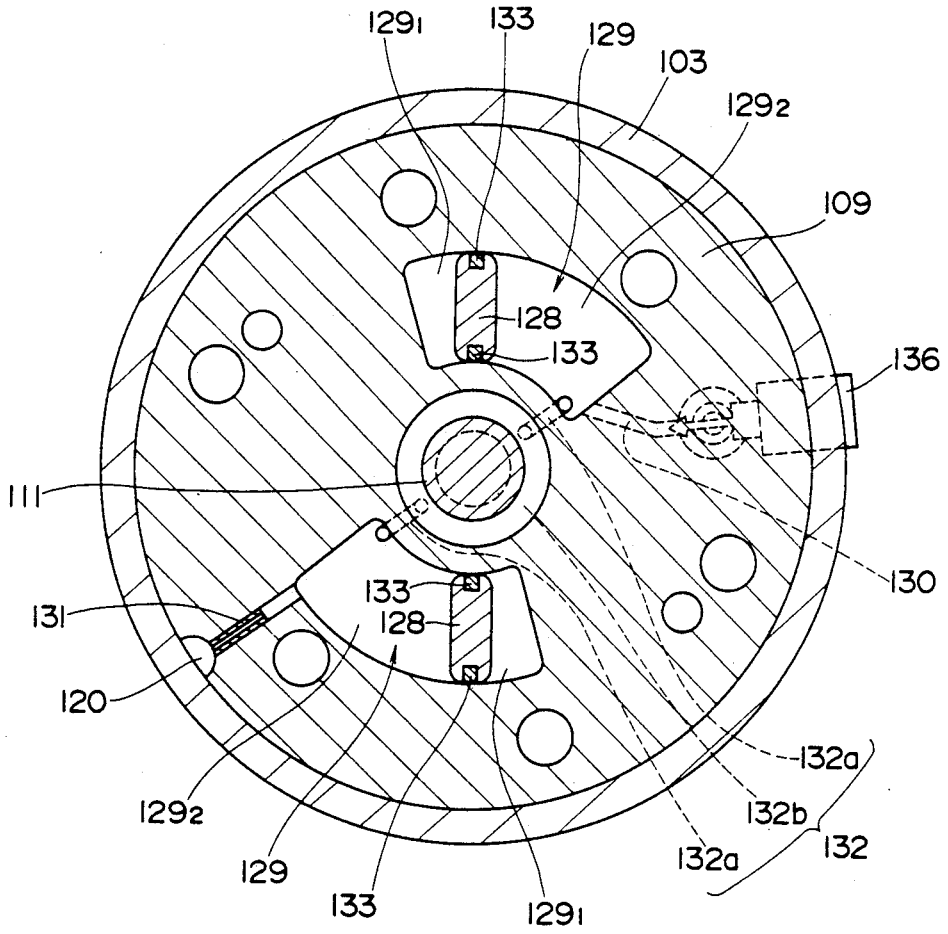
FIG. 7 is a transverse cross-sectional view taken along the line VII—VII in FIG. 4.

As shown in FIG. 6, an annular recess 124 is formed in an end face of the rear side block 109 on the side of the rotor 110. A pair of arcuate second inlet ports 125 and 125 are formed through a bottom of the recess 124, in diametrically opposite relation to each other and circumferentially extend continuously with the respective inlet ports 116, 116. The suction chamber 117 and the compression chambers 118*a* can communicate with each other through the second inlet ports 125. An annular control element 126 is fitted in the recess 124 for angular movement about the axis of the rotor shaft 111 in opposite directions, for controlling the opening angle of each of the second inlet ports 125 and 125. A pair of arcuate cut-outs 127 and 127 are formed, in diametrically opposite relation to each other, in an outer peripheral edge of the control element 126. A pair of pressure-receiving projections 128 and 128 project, in an integral manner, from one end face of the control element 126 and are arranged in diametrically opposite relation to each other. As clearly shown in FIG. 7, the pressure-receiving projections 128 and 128 are slidably fitted respectively in arcuate spaces 129 and 129 which are formed in the rear side block 109 in a manner continuous with the annular recess 124 and circumferentially partially overlapping the respective second inlets 125 and 125. Each of the spaces 129 is divided by a corresponding one of the pressure-receiving projections 128 into a first chamber $129_1$ and a second chamber or pressure controlled chamber $129_2$. The first chamber $129_1$ communicates with the suction chamber 117 through a corresponding one of the inlet parts 116 and a corresponding one of the second inlet ports 125. One of the two second chambers or pressure controlled chambers $129_2$ communicates with the suction chamber 117 through a passageway 130, while the other second chamber or pressure controlled chamber $129_2$ communicates with the discharge pressure chamber 120 through a restriction 131. These one and other second chambers $129_2$ and $129_2$ communicate with each other through a communication passageway 132. As shown in FIGS. 4 and 7, the communication passageway 132 is composed of a pair of communication bores 132*a* and 132*a* formed in a boss 109*a* integrally projecting from a center of the end face of the rear side block 109 remote from the rotor 110 and arranged in symmetrical relation with respect to the center of the boss 109*a*, and an annular space 132*b* defined between an end face of the boss 109*a* and an inner bottom surface of the rear head 103. Each of the communication bores 132*a* and 132*a* has one end opening into a corresponding one of the second chambers $129_2$ and $129_2$ and the other end opening into the annular space 132*b*.

The above-mentioned communication passageway 130 is provided within the rear side block 109.

Seal members 133 having a special configuration are mounted on the control element 126 and extend along an end face of the control element 126 and along outer peripheral surfaces of the respective pressure-receiving projections 128. By the seal members 133, sealing is provided between the first and second chambers $129_1$ and $129_2$ as shown in FIG. 7 and between the inner and outer peripheral surfaces of the control element 126 and the inner and outer peripheral surfaces of the annular recess 124 as shown in FIG. 4.

The control element 126 is biased by a coil spring 134 serving as a biasing element, in such a direction as to increase the opening angle of each second inlet port 125, i.e., in the clockwise direction as viewed in FIG. 6. The coil spring 134 is arranged about an outer periphery of the boss 109*a* of the rear side block 109 which extends into the suction chamber 117. The coil spring 134 has one and the other ends connected respectively to the boss 109*a* and the control element 126.

The communication passageway 130 has provided therein a first control valve 135 serving as pressure responsive valve means, and a second control valve 136 serving as electrically operated control means. The first control valve 135 is movable between open and closed positions in response to pressure within the suction chamber or low pressure chamber 117, that is, the suction pressure Ps. The first control valve 135 is composed of a bellows 137, a valve body 138, a ball valve member 139, and a spring 140 biasing the ball valve member 139 toward the closed position. The bellows 137 capable of expanding and contracting is arranged within the suction chamber 117 and has an axis extending parallel to the axis of the rotary shaft 111. The bellows 137 contracts when the suction pressure Ps within the suction chamber 117 is higher than a predetermined value, and expands when the suction pressure Ps is lower than the predetermined value. The valve body 138 is fitted, in a fluid-tight manner, in a fitting bore 141 which is formed in the rear side block 109 such that the fitting bore 141 extends perpendicularly to the communication passageway 130 in communication therewith. The valve body 138 is provided therein with communication bores 138*a* and 138*b* through which the interior of the valve body 138 communicates respectively with the suction chamber 117 and the fitting bore 141. The ball valve member 139 is accommodated in the valve body 138. The spring 40 is abutted against one end of the ball valve member 139 to bias same in such a direction as to close the communication bore 138*a*. The other end of the ball valve member 139 is abutted against an end face of a rod 137*a* extending from the bellows 137. When the suction pressure Ps within the suction chamber 117 is higher than the predetermined value so that the bellows 137 is in a contracted state, the ball valve member 139 closes the communication bore 138*a* under the force of the spring 140 to bring the suction chamber 117 and the communication passageway 130 out of communication with each other. On the other hand, when the suction pressure Ps within the suction chamber 117 is lower than the predetermined value so that the bellows 137 is in an expanded state, the ball valve member 139 opens the communication bore 138*a* under the action of the rod 137*a* of the bellows 137, against the force of the spring 140 to bring the suction chamber 117 and the communication passageway 130 into communication with each other.

The second control valve 136 is composed of a valve member 142 disposed for opening and closing the communication passageway 130, an electromagnetic actuator 143, and a spring 144 interposed between the electromagnetic actuator 143 and the valve member 142 to bias the latter in such a direction as to open the communication passageway 130. Like the above-described first embodiment, an electromagnetic coil 145 of the electromagnetic actuator 143 is electrically connected to an evaporator switch 43, a switch 44 and an electric power source 90.

The operation of the vane compressor constructed as above will now be described. As the rotary shaft 111 is rotated in association with a vehicle engine or the like so that the rotor 110 is rotated in the clockwise direction as viewed in FIG. 5, a centrifugal force due to rotation of the rotor 110 and back pressure $P_k$ acting upon the vanes $115_1$ to $115_5$ cooperate with each other to cause the vanes to protrude from the respective vane slits 113 radially outwardly so that tips of the respective vanes $115_1$ to $115_5$ are brought into sliding contact with the inner peripheral surface of the cam ring 107. With the tips of the respective vanes $115_1$ to $115_5$ maintained in sliding contact with the inner peripheral surface of the cam ring 107, the vanes $115_1$ to $115_5$ revolve together with the rotating rotor 110. During the suction stroke in which compression chambers 118*a* defined respectively between adjacent vanes $115_1$ to $115_5$ increase in volume, the refrigerant gas as a thermal medium is drawn into the compression chambers 118 successively through the inlet ports 116 and the second inlet ports 125. During the compression stroke in which the compression chambers 118*a* decrease in volume, the refrigerant gas is compressed. During the discharge stroke at the end of the compression stroke, the pressure of the refrigerant gas forces to open the discharge valves 121 so that the compressed refrigerant gas is supplied to the cooling system through the outlet ports 119, the discharge pressure chamber 120 and the discharge port 104 successively.

During such operation of the compressor, the suction pressure Ps within the suction chamber 117 on the low pressure side is introduced into the first chambers $129_1$ and $129_1$ of the respective spaces 129 and 129 through the inlet ports 116 and the second inlet ports 125. On the other hand, the pressure within the discharge pressure chamber 120 on the high pressure side, that is, the discharge pressure Pd is introduced, through the restriction 131, into the second chambers or pressure controlled chambers $129_2$ and $129_2$ of the respective spaces 129 and 129. Accordingly, the control element 126 angularly moves in response to a differential force between first and second forces. The first force is the sum of a force due to the pressure within the first chambers $129_1$ and the biasing force of the coil spring 134. The first force acts to urge the control member 126 in such a direction as to increase the opening angle of each second inlet port 125, that is, acts to angularly move the control element 126 in the clockwise direction as viewed in FIG. 6. The second force is a force due to the pressure Pc within the second chambers or pressure controlled chambers $129_2$. The second force acts to urge the control element 126 in such a direction as to decrease the opening angle of each second inlet port 125, that is, acts to angularly move the control element 126 in the counterclockwise direction as viewed in FIG. 6. The control element 126 angularly moves in response to the aforesaid differential force to control the opening angle of each second inlet port 125 to control the compression start timing, thereby controlling the capacity of the compressor. That is, the opening angle of each second inlet port 125 is determined by the balance or equilibrium between the force of the sum of the pressure within the first chambers $129_1$ and the force of the spring 134, and the pressure Pc within the second chambers or pressure controlled chambers $129_2$. The angular position of the control element 126 varies in a continuous manner in response to change in the suction pressure Ps within the suction chamber 117, so that the capacity of the compressor can be controlled to vary in a continuous manner.

Let it be assumed that the cooling system is started to operate, which has incorporated therein the above-described variable capacity compressor, and at the same time the switch 44 shown in FIG. 4 is turned on. Since the suction pressure Ps within the suction chamber 117 at or immediately after the start of the operation of the cooling system is higher than the predetermined value, the bellows 137 of the first control valve 135 contracts so that the ball valve member 139 closes the communication bore 138*a* under the force of the spring 140 to bring the suction chamber 117 and the communication passageway 130 out of communication with each other. This brings the suction chamber 117 and the second chambers or pressure controlled chambers $129_2$ out of communication with each other. On the other hand, since the pressure Pe within the evaporator 10 is also higher than the predetermined value, the bellows 43*b* of the evaporator switch 43 expands to bring the movable contact 43*c* into contact with the fixed contact 43*a* so that the evaporator switch 43 is turned on to energize the electromagnetic coil 145 of the second control valve 136. As a consequence, the valve member 142 closes the communication passageway 130 against the force of the spring 144, thereby bringing the suction chamber 117 and the second chambers or pressure controlled chambers $129_2$ out of communication with each other. Thus, only the discharge pressure Pd within the discharge pressure chamber 120 is introduced into the second chambers or pressure controlled chambers $129_2$ through the restriction 131. This rapidly raises the pressure Pc within the second chambers or pressure controlled chambers $129_2$ so that the pressure Pc overcomes the force of the sum of the pressure within the first chambers $129_1$ and the force of the coil spring 134, to angularly move the control element 126 in the direction of reducing the opening angle of each second inlet port 125, that is, in the counterclockwise direction as viewed in FIG. 6. The control element 126 is angularly moved to and is maintained at an angular movement limit position indicated by the solid chain line in FIG. 6, where the opening angle of each second inlet port 125 is zero.

With the control element 126 in the solid chain position, the refrigerant gas starts to be compressed when a trailing one of two adjacent vanes defining each compression chamber 118*a* reaches a leading edge 127*a* of the corresponding cut-out 127 of the control element 126, so that the compression start timing advances.

As a result, all of the refrigerant gas delivered into the compression chambers 118*a* through the inlet ports 116 is compressed and is discharged, so that the capacity of the compressor becomes maximum. Since, however, the refrigerant gas flowing into the suction chamber 117 is large in quantity, a differential pressure occurs between the pressure Pe within the evaporator 10 and the suction pressure Ps within the suction chamber 117. As the suction pressure Ps is thus brought to a level lower than the predetermined value, the bellows 137 expands to urge the ball valve member 139 against the force of the spring 140, thereby opening the communication bore 138*a*.

However, at this time the pressure Pe within the evaporator 10 is higher than the predetermined value, and is higher than a pressure level $Pt_1$ (the predetermined value $Pt_1$) corresponding to a temperature level $t_1$ at which the evaporator switch 43 is turned off. Accordingly, the bellows 43*b* of the evaporator switch 43 expands so that the evaporator switch 43 remains in the ON position, and the communication passage 130 is kept closed by the valve member 142. Therefore, the suction chamber 117 and the second chambers or pressure controlled chambers $\mathbf{129_2}$ remain out of communication with each other. Thus, the pressure Pc within the second chambers or pressure controlled chambers $\mathbf{129_2}$ remains high, so that the opening angle of each second inlet port 125 remains zero and the capacity of the compressor remains maximum. By this reason, the temperature t within the evaporator 10 rapidly drops from the initial temperature level $t_3$ at the start of operation of the cooling system, toward the target temperature tc as indicated by the curved line A in FIG. 2. When the temperature t within the evaporator 10 is brought to a level lower than the target temperature tc and further to a level lower than the freezing temperature $t_0$, the pressure Pe within the evaporator 10 also drops. When the pressure Pe is brought to the above-mentioned pressure level $Pt_1$, the bellows 43*b* of the evaporator switch 43 contracts to turn the switch 44 off, so that the valve member 142 opens the communication passageway 130 under the force of the spring 144 to bring the suction chamber 117 and the second chambers or pressure controlled chambers $\mathbf{129_2}$ into communication with each other. Accordingly, the pressure Pc within the second chambers or pressure controlled chambers $\mathbf{129_2}$ leaks to the suction chamber 117 through the communication bores 138*a* and 139*b* and the communication passageway 130. This causes the pressure Pc within the second chambers or pressure controlled chambers $\mathbf{129_2}$ to rapidly drop, so that the control element 126 is angularly moved in the clockwise direction as viewed in FIG. 6 toward a position as shown by the two-dot chain line in FIG. 6. Accordingby, the refrigerant gas starts to be compressed when a trailing one of two adjacent vanes defining each compression chamber 118*a* reaches a leading edge 127*a* of the cut-out 127. Therefore, the compression start timing is delayed by an amount corresponding to the opening degree of the ports 125, and the amount of compression of the refrigerant gas within the compression chambers 118*a* is reduced, so that the capacity of the compressor decreases. The remaining operations and effects of the third embodiment are similar to those of the above-described first embodiment, and the description of the remaining operations and effects is therefore omitted.

What is claimed is:

1. A variable capacity vane-type compressor for use in a heat-exchange circuit including an evaporator having an outlet for a refrigerant gas, said compressor comprising:

a plurality of compression chambers defined respectively between adjacent vanes mounted in a rotor for radial sliding movement;

a low pressure chamber connected to said outlet of said evaporator;

a pressure controlled chamber;

communication passageway means extending between said low pressure chamber and said pressure controlled chamber;

pressure responsive valve means provided in said communication passageway means and movable, in response to pressure within said low pressure chamber, between a closed position where said pressure responsive valve means closes said communication passageway means to bring said low pressure chamber and said pressure controlled chamber out of communication with each other and an open position where said pressure responsive valve means opens said communication passageway means to bring said low pressure chamber and said pressure controlled chamber into communication with each other, to control pressure within said pressure controlled chamber, thereby varying the capacity of the compressor in such a manner as to reduce the capacity when the pressure within said low pressure chamber decreases to a level lower than a predetermined value;

detecting means for detecting either one of pressure and temperature of the refrigerant gas in said evaporator, to generate a signal; and electrically operated control means operative in response to the signal from said detecting means for maintaining the capacity of the compressor large independently of operation of said pressure responsive valve means, even if the pressure within said low pressure chamber decreases to a level lower than said predetermined value.

2. A variable capacity compressor as defined in claim 1, wherein said electrically operated control means comprises an electrically operated valve means provided in said communication passageway means at a location between said pressure responsive valve means and said pressure controlled chamber, said electrically operated valve means being movable between an open position where said electrically operated valve means opens said communication passageway means and a closed position where said electrically operated valve means closes said communication passageway means.

3. A variable capacity compressor as defined in claim 2, including an electric power source connectable to said electrically operated valve means, and wherein said detecting means comprises switch means movable in response to the pressure within said evaporator between an ON position where said electric power source and said electrically operated valve means are electrically connected to each other to move said electrically operated valve means to said open position and an OFF position where said electric power source and said electrically operated valve means are electrically disconnected from each other to move said electrically operated valve means to said closed position.

4. A variable capacity compressor for use in a heat-exchange circuit including an evaporator having an outlet for a refrigerant gas, said compressor comprising:

a low pressure chamber connected to said outlet of said evaporator;

a pressure controlled chamber;

communication passageway means extending between said low pressure chamber and said pressure controlled chamber;

pressure responsive valve means provided in said communication passageway means and movable, in response to pressure within said low pressure chamber, between a closed position where said pressure responsive valve means closes said communication passageway means to bring said low pressure chamber and said pressure controlled chamber out of communication with each other and an open position where said pressure responsive valve means opens said communication passageway means to bring said low pressure chamber and said pressure controlled chamber into communication with each other, to control pressure within said pressure controlled chamber, thereby varying the capacity of the compressor in such a manner as to reduce the capacity when the pressure within said low pressure chamber decreases to a level lower than a predetermined value;

detecting means for detecting either one of pressure and temperature of the refrigerant gas in said evaporator, to generate a signal;

electrically operated control means operative in response to the signal from said detecting means for maintaining the capacity of the compressor large independently of operation of said pressure responsive valve means, even if the pressure within said lower pressure chamber decreases to a level lower than said predetermined value;

said electrically operated control means comprising an electrically operated valve means provided in said communication passageway means at a location between said pressure responsive valve means and said pressure controlled chamber, said electrically operated valve means being movable between an open position where said electrically operated valve means opens said communication passageway means and a closed position where said electrically operated valve means closes said communication passageway means;

an electric power source connectable to said electrically operated valve means;

said detecting means comprising switch means movable in response to the pressure within said evaporator between an ON position where said electric power source and said electrically operated valve means are electrically connected to each other to move said electrically operated valve means to said open position and an OFF position where said electric power source and said electrically operated valve means are electrically disconnected from each other to move said electrically operated valve means to said closed position; and a manually operated switch serially connected between said switch means of said detecting means and said electric power source, said manually operated switch assuming an ON position where said electric power source and said electrically operated valve means are electrically connected to each other if said switch means is in said ON position, and an OFF position where said electric power source and said electrically operated valve means are electrically disconnected from each other even if said switch means is in said ON position.

5. A variable capacity compressor as defined in claim 4, wherein aid pressure responsive valve means is moved to said open position when the pressure within said low pressure chamber is lower than said predetermined value, and to said closed position when the pressure within said low pressure chamber is higher than said predetermined value.

6. A variable capacity compressor as defined in claim 5, wherein the compressor is of a vane type in which a plurality of compression chambers are defined respectively between adjacent vanes mounted in a rotor for radial sliding movement.

7. A variable capacity vane-type compressor for use in a heat-exchange circuit including an evaporator having an outlet for a refrigerant gas, said compressor comprising:

a plurality of compression chambers defined respectively between adjacent vanes mounted in a rotor for radial sliding movement;

a low pressure chamber connected to said outlet of said evaporator;

a pressure controlled chamber;

communication passageway means extending between said low pressure chamber and said pressure controlled chamber;

pressure responsive valve means provided in said communication passageway means and movable, in response to pressure within said low pressure chamber, between a closed position where said pressure responsive valve means closes said communication passageway means to bring said low pressure chamber and said pressure controlled chamber out of communication with each other and an open position where said pressure responsive valve means opens said communication passageway means to bring said low pressure chamber and said pressure controlled chamber into communication with each other, to control pressure within said pressure controlled chamber, thereby varying the capacity of the compressor in such a manner as to reduce the capacity when the pressure within said low pressure chamber decreases to a level lower than a predetermined value;

said pressure responsive valve means being movable to said open position when the pressure within said low pressure chamber is lower than said predetermined value, and to said closed position when the pressure within said low pressure chamber is higher than said predetermined value;

detecting means for detecting either one of pressure and temperature of the refrigerant gas in said evaporator, to generate a signal; and electrically operated control means operative in response to the signal from said detecting means for maintaining the capacity of the compressor large independently of operation of said pressure responsive value means, even if the pressure within said low pressure chamber decreases to a level lower than said predetermined value.

8. A variable capacity compressor as defined in claim 7, wherein said electrically operated control means comprises an electrically operated valve means provided in aid communication passageway means at a location between said pressure responsive valve means and said pressure controlled chamber, said electrically operated valve means being movable between an open position where said electrically operated valve means opens said communication passageway means and a closed position where said electrically operated valve means closes said communication passageway means.

9. A variable capacity compressor as defined in claim 8, including an electric power source connectable to said electrically operated valve means, and wherein said detecting means comprises switch means movable in response to the pressure within said evaporator between an ON position where said electric power source and said electrically operated valve means are electrically connected to each other to move said electrically operated valve means to said open position and an OFF position where said electric power source and said electrically operated valve means are electrically disconnected from each other to move said electrically operated valve means to said closed position.

10. A variable capacity compressor as defined in claim 9, including a manually operated switch serially connected between said switch means of said detecting means and said electric power source, aid manually operated switch assuming an ON position where said electric power source and said electrically operated valve means are electrically connected to each other if said switch means is in said ON position, and an OFF position where said electric power source and said electrically operated valve means are electrically disconnected from each other even if said switch means is in said ON position.

11. A variable capacity compressor for use in a heat-exchange circuit including an evaporator having an outlet for a refrigerant gas, said compressor comprising:

a low pressure chamber connected to said outlet of said evaporator;

a pressure controlled chamber;

communication passageway means extending between said low pressure chamber and said pressure controlled chamber;

pressure responsive valve means provided in said communication passageway means and movable, in response to pressure within said low pressure chamber, between a closed position where said pressure responsive valve means closes said communication passageway means to bring said low pressure chamber and said pressure controlled chamber out of communication with each other and an open position where said pressure responsive valve means opens said communication passageway means to bring said low pressure chamber and said pressure controlled chamber into communication with each other, to control pressure within said pressure controlled chamber, thereby varying the capacity of the compressor in such a manner as to reduce the capacity when the pressure within said low pressure chamber decreases to a level lower than a predetermined value;

detecting means for detecting either one of pressure and temperature of the refrigerant gas in said evaporator, to generate a signal;

electrically operated control means operative in response to the signal from said detecting means for maintaining the capacity of the compressor large independently of operation of said pressure responsive valve means, even if the pressure within said low pressure chamber decreases to a level lower than said predetermined value;

said pressure responsive valve means being moved to said open position when the pressure within aid low pressure chamber is higher than said predetermined value, and to said closed position when the pressure within said low pressure chamber is lower than said predetermined value;

said electrically operated control means being operatively connected to said pressure responsive valve means for maintaining same in said open position even if the pressure within said low pressure chamber is lower than said predetermined value;

said pressure responsive valve means (29) comprising a valve member (29*a*) for opening and closing said communication passageway means (37); urging means (29*c*, 29*d*) which is deformable in response to pressure within said low pressure chamber for urgingly displacing said valve member; and a plate member (29*b*) supporting said urging means; and said electrically operated control means (70) comprises a movable core (72) secured to said plate member (29*b*); a stationary member (16) disposed opposite said movable core (72); spring means (41) interposed between said movable core (72) and said stationary member (16) for biasing said movable core and said plate member in a direction such that said valve member (29*a*) closes said communication passageway means (37); and an electromagnetic actuator means (40) interposed between said movable core (72) and said stationary member (16) for biasing said movable core and said stationary member in a direction opposite to said direction against the force of said spring means, when energized.

12. A variable capacity compressor as defined in claim 11, wherein said pressure responsive valve means is moved to said open position when the pressure within said low pressure chamber is higher than said predetermined value, and to said closed position when the pressure within said low pressure chamber is lower than said predetermined value.

13. A variable capacity compressor as defined in claim 12, wherein aid communication passageway means comprises first and second communication passageways extending in parallel relation to each other, said pressure responsive valve means being provided in aid first communication passageway for opening and closing same, said electrically operated control means comprising electrically operated valve means provided in said second communication passageway for movement in response to the signal from said detecting means, between a closed position where said electrically operated valve means closes said second communication passageway and an open position where said electrically operated valve means opens said second communication passageway.

14. A variable capacity compressor as defined in claim 13, wherein the compressor is of the wobble-plate type in which a wobble plate is arranged within a crank chamber for swinging movement, and wherein said pressure controlled chamber comprises said crank chamber.

15. A variable capacity compressor for use in a heat-exchange circuit including an evaporator having an outlet for a refrigerant gas, said compressor comprising:

a low pressure chamber connected to said outlet of aid evaporator;

a pressure controlled chamber;

communication passageway means extending between said low pressure chamber and said pressure controlled chamber, said communication passageway means comprising first and second communication passageways extending in parallel relation to each other;

pressure responsive valve means provided in said first communication passageway and movable, in response to pressure within said low pressure chamber, between a closed position where said pressure responsive valve means closes said communication passageway means to bring said low pressure chamber and said pressure controlled chamber out of communication with each other and an open position where said pressure responsive valve means opens said communication passageway means to bring said low pressure chamber and said pressure controlled chamber into communication with each other, to control pressure within said

16. A variable capacity compressor as defined in claim 15, wherein said pressure responsive valve means is moved to said open position when the pressure within said low pressure chamber is higher than said predetermined value, and to said closed position when the pressure within said low pressure chamber is lower than said predetermined value.

17. A variable capacity compressor as defined in claim 15, wherein the compressor is of the wobble-plate type in which a wobble plate is arranged within a crank chamber for swinging movement, and wherein said pressure controlled chamber comprises said crank chamber.

18. A variable capacity compressor as defined in claim 17, wherein said communication passageway means comprises first and second communication passageways extending in parallel relation to each other, said pressure responsive valve means being provided in said first communication passageway for opening and closing same, said electrically operated control means comprising electrically operated valve means provided in said second communication passageway for movement in response to the signal from said detecting means, between a closed position where said electrically operated valve means closes said second communication passageway and an open position where said electrically operated valve means opens said second communication passageway.

19. A variable capacity compressor as defined in claim 18, including an electric power source connectable to said electrically operated valve means, and wherein said detecting means comprises switch means movable in response to the pressure within said evaporator between an ON position where said electric power source and said electrically operated valve means are electrically connected to each other to move said electrically operated valve means to said open position and an OFF position where said electric power source and said electrically operated valve means are electrically disconnected from each other to move said electrically operated valve means to said closed position.

* * * * *

UNITED STATES PATENT AND TRADEMARK OFFICE

CERTIFICATE OF CORRECTION

PATENT NO. : 5,017,096

DATED : May 21, 1991

INVENTOR(S) : SUGIURA et al

It is certified that error appears in the above-identified patent and that said Letters Patent is hereby corrected as shown below:

Column 17, line 56 (Claim 5), change "aid pressure" to read --said pressure--.

Column 19, line 6 (Claim 10), change "aid manually" to read --said manually--.

Column 19, line 54 (Claim 11), change " within aid" to read -- within said--.

Column 20, line 26 (Claim 13), change "aid communication" to read --said communication--.

Column 20, line 50 (Claim 15), change "aid evaporator;" to read --said evaporator;--.

Column 21, line 2 (Claim 15), after "pressure within said", insert the following:

--pressure controlled chamber, thereby varying the capacity of the compressor in such a manner as to reduce the capacity when the pressure within said low pressure chamber decreases to a level lower than a predetermined value;

detecting means for detecting either one of pressure and temperature of the refrigerant gas in said evaporator, to generate a signal;

electrically operated control means operative in response to the signal from said detecting means for It is certified that error appears in the above-identified patent and that said Letters Patent is hereby corrected as shown below:

maintaining the capacity of the compressor large independently of operation of said pressure responsive valve means, even if the pressure within said low pressure chamber decreases to a level lower than said predetermined value;

said electrically operated control means comprising electrically operated valve means provided in said second communication passageway for movement in response to the signal from said detecting means, between a closed position where said electrically operated valve means closes said second communication passageway and an open position where said electrically operated valve means opens said second communication passageway;

an electric power source connectable to said electrically operated valve means;

said detecting means comprising switch means movable in response to the pressure within said eveporator between an ON position where said electric power source and said electrically operated valve means are electrically connected to each other to move said electrically operated valve means to said open position and an OFF position where said electric power source and said electrically operated valve

UNITED STATES PATENT AND TRADEMARK OFFICE

CERTIFICATE OF CORRECTION

PATENT NO. : 5,017,096

DATED : May 21, 1991

INVENTOR(S) : SUGIURA et al

It is certified that error appears in the above-identified patent and that said Letters Patent is hereby corrected as shown below:

means are electrically disconnected from each other to move said electrically operated valve means to said closed position; and a manually operated switch serially connected between said switch means of said detecting means and said electric power source, said manually operated switch assuming an ON position where said electric power source and said electrically operated valve means are electrically connected to each other if said switch means is in said ON position, and an OFF position where said electric power source and said electrically operated valve means are electrically disconnected from each other even if said switch means is in said ON position.--

Signed and Sealed this

Eighth Day of June, 1993

*Attest:*

Michael K. Kirk

MICHAEL K. KIRK

*Attesting Officer*

*Acting Commissioner of Patents and Trademarks*